United States Patent [19]

Berry et al.

[11] 4,406,455

[45] Sep. 27, 1983

[54] SECTIONALIZED BOWLING LANE AND METHOD OF ASSEMBLY THEREOF

[75] Inventors: Foster W. Berry; Robert Torresen, both of Muskegon, Mich.

[73] Assignee: Brunswick Corporation, Skokie, Ill.

[21] Appl. No.: 334,400

[22] Filed: Dec. 24, 1981

Related U.S. Application Data

[63] Continuation of Ser. No. 35,277, May 1, 1979, abandoned, which is a continuation-in-part of Ser. No. 966,394, Dec. 4, 1979, abandoned.

[51] Int. Cl.[3] ..... A63D 1/04; A63D 1/08

[52] U.S. Cl. ..... 273/51; 29/469; 29/526 R; 52/126.7; 52/309.1; 52/747; 144/347; 156/71; 156/94; 428/425.1; 428/525; 428/528; 428/529

[58] Field of Search ..... 52/126.7, 309.1, 747; 144/309 P, 309 Q; 29/469, 526 R; 156/71, 94; 273/51; 428/425.1, 525, 528, 529

[56] References Cited

U.S. PATENT DOCUMENTS

| | | | |
|---|---|---|---|
| 4,169,602 | 10/1979 | Heddon | 273/51 |
| 4,231,573 | 11/1980 | Kelly | 273/51 |
| 4,269,411 | 5/1981 | Heddon | 273/51 |
| 4,307,883 | 12/1981 | Kelly | 273/51 |
| 4,320,898 | 3/1982 | Brunst et al. | 273/51 |

*Primary Examiner*—Michael R. Lusignan

*Attorney, Agent, or Firm*—Wood, Dalton, Phillips, Mason & Rowe

[57] ABSTRACT

A bowling lane comprises a plurality of sections of longitudinally extending laminated panels supported by a foundation having means for leveling the lane sections during installation. The panels each have a decoratively printed upper surface of a plastic laminate or polyurethane which simulates the appearance and bowling characteristics of natural wooden lanes.

28 Claims, 15 Drawing Figures

SECTIONALIZED BOWLING LANE AND METHOD OF ASSEMBLY THEREOF

CROSS-REFERENCE TO RELATED APPLICATION

This is a continuation of application Ser. No. 35,277 filed May 1, 1979, now abandoned, which is a continuation-in-part of application Ser. No. 966,394, filed Dec. 4, 1979, now abandoned.

BACKGROUND OF THE INVENTION

This invention relates to synthetic bowling surfaces and methods of assembly thereof. More specifically, this invention relates to a sectionalized bowling lane comprising a plurality of laminated panels each having a surface of synthetic plastic laminate or polymeric coating.

Heretofore, bowling lanes have generally been constructed of transversely laminated longitudinally extending wooden strips having a lacquered bowling surface. The approach and head sections of the lanes were of relatively hard maple and terminated in a splice with a relatively soft pine section. The pine section terminated at a highly impact- and abrasion-resistant pin deck.

As is well known in the art, the wooden strips are secured to each other by mechanical means, such as nails, and by adhesives, and had a substantial thickness to allow periodic resurfacing. Lane fabrication, generally conducted on-site, is laborious, time-consuming and expensive, and is further complicated by the requirement that the bowling surface be substantially level and that the surface characteristics be substantially uniform.

Wooden bowling lanes are characterized by a number of functional disadvantages. Since various surface characteristics of wood may be controlled only to a limited degree, the surface appearance and characteristics of wooden bowling lanes may be non-uniform from lane to lane and within an individual lane.

More significantly, wooden lane surfaces become worn and require periodic resurfacing, generally performed annually, comprising sanding of the surface to a uniform level to eliminate cracks, grooves and other damage, followed by relacquering. The resurfacing operation generally requires a shut-down of the bowling establishment of at least one day. The sanding and relacquering operation creates substantial debris and, more significantly, is dangerous due to the flammable or explosive nature of the lacquers typically best suited for lane refinishing.

Annual lane refinishing is time-consuming and expensive due to several factors. Revenue is foregone during the required shut-down of the bowling establishment, and the direct material and labor costs of resurfacing and clean-up are significant. The fire and explosion risks associated with the use of resurfacing lacquers tend to significantly increase the bowling proprietor's casualty insurance premiums.

The expected life of conventional wooden lanes varies from between 20 to about 30 years. Due to yearly resurfacing, the lane thickness decreases until the nails joining the lane's wooden strips are exposed, rendering the lane unusable. Areas of heavy ball impact, such as the head sections, are subjected to relatively great amounts of stress and therefore become damaged before other lane sections. The degree of wear experienced by a given lane section controls the level to which the entire lane must be sanded during resurfacing.

Since wooden lane surfaces are constructed of wooden strips of random length, removal and replacement of a lane section is generally impractical. An entire lane must generally be replaced when one section has become so badly worn as to reduce the lane level to an unusable point. As a result, replacement of an entire lane often may involve removal of one or more relatively undamaged lane sections, resulting in significant waste.

SUMMARY OF THE INVENTION

The present invention is directed to overcoming one or more of the problems as set forth above.

The present invention provides a sectionalized bowling lane construction and method of assembly thereof in order to provide a durable bowling surface of uniform appearance and bowling characteristics which requires relatively little maintenance and which, if damaged, may be repaired or replaced on a section-by-section basis. Expensive and hazardous refinishing operations are thereby eliminated.

According to the present invention, first and second types of synthetic panels, corresponding to the approach, head and pin deck sections, and to the pine sections, respectively, of a conventional wooden bowling lane, are provided. The first type of panel, corresponding to the approach, head and pin deck sections as well as the filler sections between approach sections, comprises a multi-layer laminate preferably having three internal layers of varying densities and hardness, with upper and lower surface layers of a highly impact- and abrasion-resistant plastic laminate. The upper laminate layer of each of the head, approach and filler sections includes a decoratively printed paper layer which simulates the appearance of a natural maple bowling lane.

The second type of panel, corresponding to the conventional pine sections of a wooden lane, comprises a single layer of intermediate-density resin-bonded particle board or fiber board having a decoratively printed upper surface which has been coated with several layers of a highly abrasion-resistant polyurethane.

The sections of the bowling lane are supported by a crib foundation having means for leveling the lane sections during assembly before the lane sections are secured to the foundation. The lane supporting structure may be partially disassembled if a single section of the lane becomes damaged or worn in order to allow disassembly and replacement of one or more sections.

The sections of the lane are prefabricated and are readily assembled on-site. Only minimal surface maintenance is required.

DETAILED DESCRIPTION OF THE PREFERRED EMBODIMENTS

Figures 1, 2, 2A, 2B:
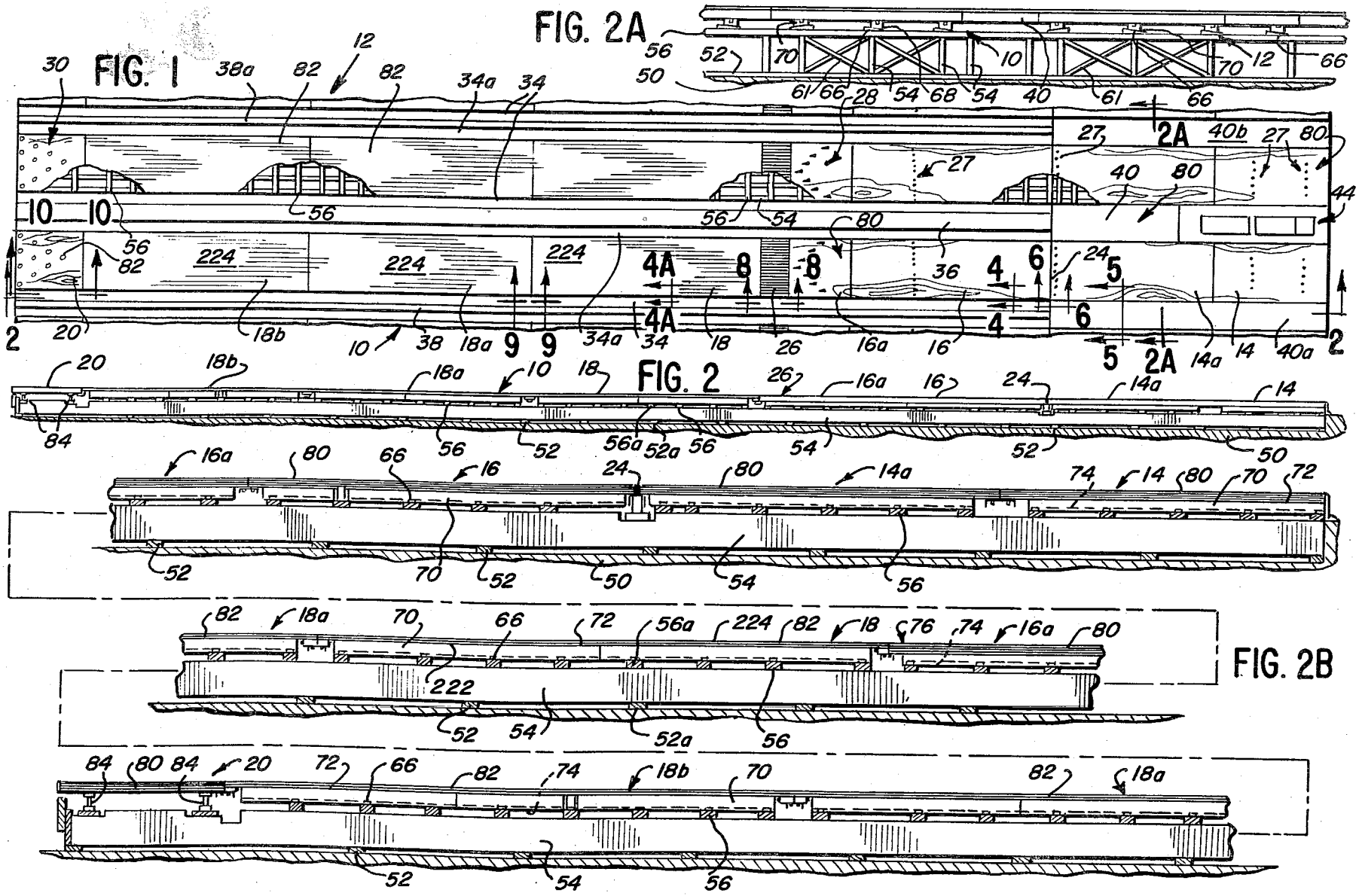
FIG. 1 is a top plan view, with portions broken away for clarity, of a pair of bowling lanes made according to the present invention.
FIG. 2 is a sectional elevation of a lane of FIG. 1 taken approximately along the line 2—2 of FIG. 1.
FIG. 2A is an enlarged sectional elevation of the lanes of FIG. 1 taken approximately along the line 2A—2A of FIG. 1.
FIG. 2B is a fragmentary segmented elevation of the lane of FIG. 2.

Referring to FIG. 1, a pair of bowling lanes, generally designated 10 and 12, constructed according to the present invention are shown. Each lane 10 and 12 comprises a series of longitudinally extending lane sections, conventionally referred to, forward to rear, as approach sections 14 and 14*a*, head sections 16 and 16*a*, pine sections 18, 18*a* and 18*b*, and a pin deck 20. A transversely extending foul line 24 is disposed between the rearmost approach section 14*a* and the forward head section 16, and a splice section 26 integral with the rear head section 16*a* abuts the forward pine section 18. The approach sections 14 and 14*a* and the head sections 16 and 16*a* have rangefinder dots 27 and arrows 28, and the pin deck 20 has pin spots 30.

A pair of longitudinally extending gutters 34 and 34*a* are disposed adjacent each lane 10 and 12 on opposite sides thereof, and a ball return tunnel 35 separates the right-hand gutter 34*a* of the lane 10 and the left-hand gutter 34 of the lane 12. Relatively narrow filler strips 38 and 38*a* separate the gutters 34 and 34*a* of the lanes 10 and 12 from those of additional lanes (not shown) adjacent thereto.

Filler sections 40, 40*a* and 40*b* and a ball return mechanism 44, shown schematically, separate the approach sections 14 and 14*a* of the lanes 10 and 12 from each other and from the approach sections of adjacent lanes.

Referring to FIGS. 2–2B, the supporting structure of the lanes 10 and 12 is shown. A concrete or similar foundation 50 supports a plurality of longitudinally spaced, transversely extending 2×4 wooden sleepers 52 which in turn support a plurality of transversely spaced, longitudinally extending upright 2×10 wooden stringers 54. A plurality of longitudinally spaced, transversely extending 2×4 wooden levelers 56 are supported by the stringers 54. As seen in FIG. 2A, pairs of stringers 54 located directly under each lane 10 and 12 are braced by longitudinally spaced pluralities of cross members 61 extending diagonally between associated vertically aligned pairs of levelers 56*a* and sleepers 52*a*.

Figure 3:
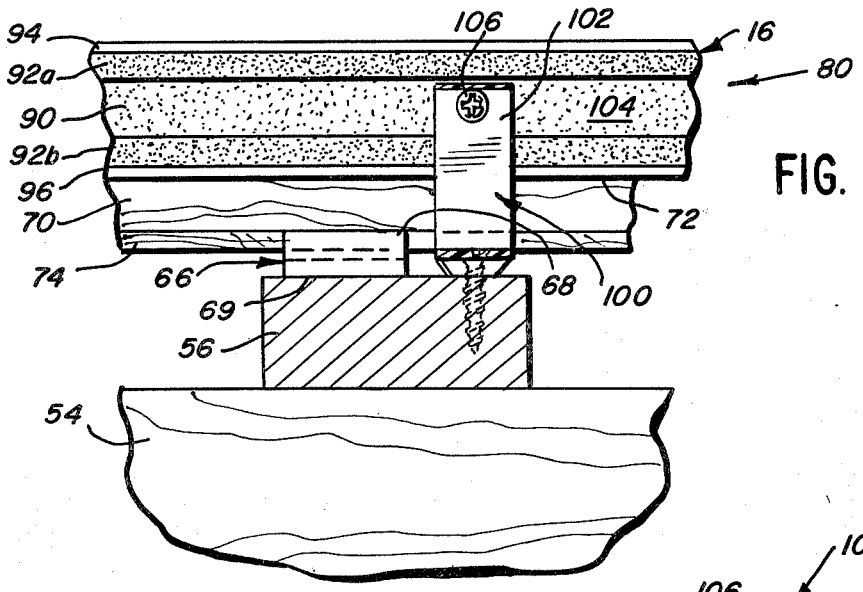
FIG. 3 is an enlarged sectional elevation of a portion of the lane of FIGS. 1 and 2 taken generally along the line 3—3 of FIG. 4.
Figure 4:
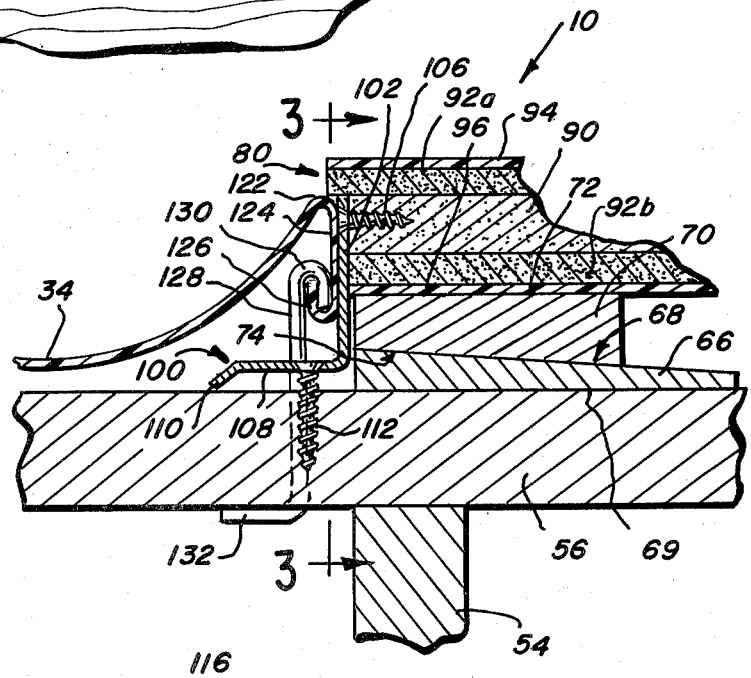
FIG. 4 is an enlarged sectional elevation of a portion of the lane of FIGS. 1 and 2 taken approximately along the line 4—4 of FIG. 1.
Figure 4A:
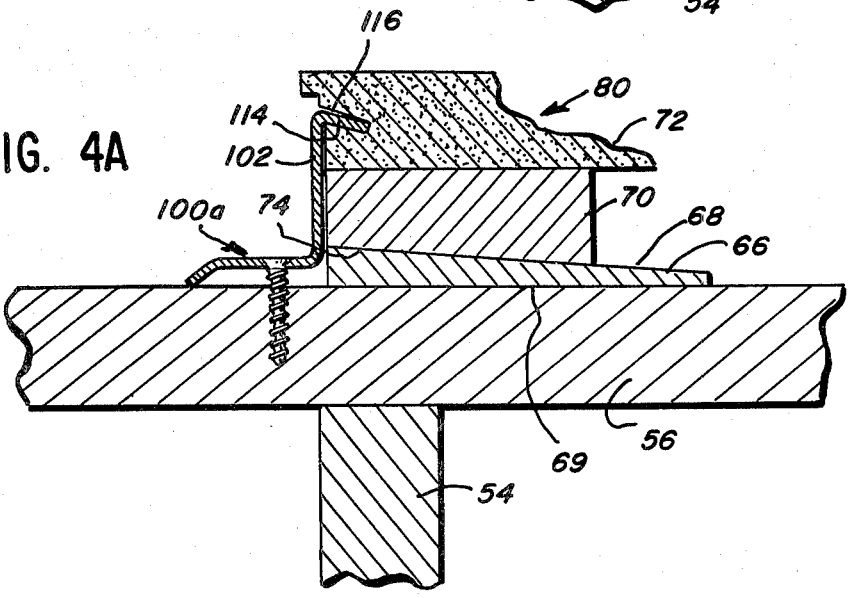
FIG. 4A is a sectional elevation of an alternate embodiment of the hold-down structure of FIG. 4 taken approximately along the line 4A—4A of FIG. 1.

A plurality of transversely spaced leveling wedges 66, each having an inclined upper surface 62 and a flat horizontal lower surface 69, best seen in FIGS. 3 through 4A, is supported by each leveler 56 substantially in longitudinal alignment with similar leveling wedges 66 supported by parallel levelers 56.

A plurality of longitudinally extending bevel strips 70 is supported by each set of longitudinally aligned leveling wedges 66. Each bevel strip 70 has a flat horizontal upper surface 72 and an inclined lower surface 74 mating with the inclined upper surface 68 of an associated leveling wedge 66.

The structure of the lane sections 14 through 18*b*, the filler strips 40–40*b*, and the pin deck 20 will now be described in detail. The lane sections 14 through 18*b* comprise individual panels of first and second types 80 and 82. The lane sections 14 through 16*a* and the filler sections 40–40*b* comprise longitudinally extending panels 80 of the first type, each panel 80 comprising a multi-layer laminate, illustratively of panels of resin-bonded fiber board or particle board, with outer layers of a decorative and highly impact- and abrasion-resistant plastic laminate. The sections 80 extend longitudinally from the forwardmost point of each lane 10 and 12 to the foul line 24, and therefrom to the rearmost point of the splice section 26.

The lane sections 18–18*b* ("pine" sections) comprise panel 82 of the second type, each panel 82 comprising a single layer of intermediate-density resin-bonded particle board or fiber board with a decoratively printed upper surface coated with several layers of a highly impact- and abrasion-resistant polyurethane. The lane sections 18–18*b* extend longitudinally between the splice section 26 to the pin deck 20, which pin deck 20 is of a multi-layer laminate of the first type 80.

Each of the panels 80 and 82, except for the pin deck panel 80, is supported by a plurality of parallel, longitudinally extending bevel strips 70, described above, and are secured together at their interfaces by means described below. The pin deck 20 is supported by independent support means 84, also described below.

Referring now to FIG. 3, the structure of a multi-layer panel 80 is described in detail. The panel 80 of FIG. 3 comprises the approach section 16, but the panel structure described herein is representative of each panel 80. The panel 80 is supported on the horizontal upper surface 72 of a bevel strip 70, and comprises symmetrically disposed multiple layers including a central core layer 90 of any of a variety of materials, intermediate layers 92*a* and 92*b* of phenol-formaldehyde resin-bonded particle board, and respective upper and lower surface layers 94 and 96 of a highly impact- and abrasion-resistant decorative plastic laminate. Although three interior layers 90–92*b* are shown, it is to be understood that symmetrical construction and overall thickness and strength, not the number of layers, is critical in accomplishing the objects of the invention. Symmetrical construction of the panels 80 prevents warping thereof which would otherwise occur due to unequal expansion and contraction due to temperature and humidity effects.

The central core layer 90 performs a spacing and support function, and may comprise any material capable of supporting the layers 92, 94 and 96 during use. A preferred material, due in part to economic considerations, is intermediate-density (about 45 lb./ft.$^3$) resin-bonded fiber board or particle board.

The intermediate layers 92*a* and 92*b* are of a material, typically a relatively high-density (about 65 lb./ft.$^3$) phenol-formaldehyde resin-bonded particle board, having physical properties to be described below, rendering the material suitable for distributing ball impact without suffering permanent deformation.

The layers 94 and 96 are of a laminated cellulose/-melamine-formaldehyde/Kraft paper composite, similar to laminates marketed in the trademark Formica, and layer 94 includes a layer of decoratively printed paper which simulates the appearance of maple. The decorative paper layer is typically printed by a cylinder printer with the design repeated about every two feet to provide a natural, yet uniform, appearance from lane to lane. Rangefinder dots 27 and arrows 28 are silk-screened on the printed paper in the head and approach section panels.

The printed paper layer is impregnated with a melamine-formaldehyde polymer and then laminated between a core of several layers of phenol-formaldehyde-impregnated Kraft paper and a transparent top layer of melamine-formaldehyde-impregnated alpha-cellulose having extremely high impact and abrasion resistance. After curing, the laminate thickness is approximately $\frac{1}{8}$ inch. The structure of the lower laminate layer 96 is closely similar to that of the upper layer 94, but need not be decoratively printed and may be coated with a melamine-formaldehyde polymer of substantially less impact and abrasion resistance than that used to coat the upper layer 94, if desired, as long as the lower layer 96 has the same water vapor absorbency and temperature expansion characteristics as the upper layer 94.

Each panel 92*a* and 92*b* comprises a material selected to have hardness, tensile strength and stiffness (elastic modulus) characteristics sufficient to uniformly distribute stress imparted by a lofted bowling ball from the overlying laminate panel 94 to the underlying lane supporting structure over a sufficiently wide area to prevent permanent deformation of the laminate 94 or the panels 90, 92*a* or 92*b*, which could result in cracking of, or other damage to, the laminate panel 94.

Though the panels 92*a*, 92*b* must be capable of resisting a wide range of lofted ball impacts (due to the varying ball weights and loft heights encountered in use), the panels 92*a*, 92*b* must not absorb such excessive amounts of ball energy as to result in "dead" lanes having unnatural bowling characteristics.

Materials exhibiting characteristics falling within the following ranges are suitable for use in the panels 92*a*, 92*b* of the present invention;

Hardness: between about 2500 lb. (as measured by the Janka Hardness Test, ASTM D1037, ¶ ¶ 68–70) and about M100 Rockwell, as measured according to ASTM D785-65;

Internal Bond Strength (Tensile Strength) of greater than about 320 psi, as measured according to ASTM D1037, ¶ ¶ 28–33; and Elastic Modulus (bending) between about 400,000 psi and 1,300,000 psi, as measured according to ASTM D1037, ¶ ¶ 11–30.

The required thickness of a panel of material having specific characteristics within the ranges defined above is readily empirically determined. Density may vary between about 62–87 lb./ft.$^3$.

One material which has been found to provide an excellent material for use in the panels 92*a*, 92*b* of the invention is a phenol-formaldehyde resin-bonded particle board marketed under the trademark Resincore I by Resinwood Division of Rodman Industries, Inc. of Marinette, Wisconsin. Resincore I has a density of about 62–65 lb./ft.$^3$, internal bond strength of about 350 psi, a hardness of about 3,000 lb., and an elastic modulus of about 680,000 psi. The preferred thickness of panels 92*a* and 92*b* of Resincore I is about $\frac{3}{8}$ inch. It has been found that conventional urea resin-bonded particle board or fiber board has insufficient internal bond strength (in the range of about 150–200 psi) to provide acceptable material for use as the layers 92*a*, 92*b* in the practice of the present invention.

The central core layer 90 is illustratively of a commercial grade urea resin-bonded particle board or fiber board and need not be of the high density and strength of the layers 92*a* and 92*b*, since the central core 90 is relatively insulated from ball impact by the layers 92–96. The preferred thickness of the layer 90 is about $\frac{3}{4}$ inch. The total thickness of each panel 80 is therefore about $1\frac{3}{4}$ inch.

The panels 80 are prefabricated, as by gluing under pressure with curable adhesive, such as a catalyzed vinyl glue, spread between the panels 90–96. The use of a curable adhesive is economical, and allows the panels to be properly aligned before the application of pressure. After gluing, the panels 80 may be trimmed to size if required.

The structure of the filler sections 40 and the pin deck 20 is identical to the above-described structure except that the central core layer of the pin deck 20 is of a high-density material, such as particle board. This is necessitated by the extremely high intensity of ball and pin impact required to be absorbed by the pin deck 20.

Each of the panels 82 corresponding to the lane sections 18, 18*a* and 18*b* comprises a panel 97 of commercial grade intermediate-density (about 44 lb./ft.$^3$) resin-bonded particle board or fiber board having flat upper and lower surfaces 98 and 99, respectively. Since the sections 18–18*b* receive minimal direct ball impact but, rather, predominantly rolling ball contact, the support provided by an intermediate-density composite 97 is sufficient to avoid visually detectable surface damage. Further, intermediate-density particle board is relatively inexpensive and use thereof therefore decreases overall lane cost.

The upper surface 98 of each panel 97 comprises one or more opaque layers of suitable lacquer or other coating upon which is printed a simulated pine design. Several layers of highly impact- and abrasion-resistant polyurethane, such as marketed by the assignee hereof under the trademark "Astrolane 100" cover the printed layer. Astrolane 100 brand polyurethane is formulated to closely reproduce the bowling characteristics of natural wood and may be readily reapplied as required should the surface 98 become worn. Such a polyurethane coating involves no danger of fire or explosion such as may be encountered with the use of a lacquer surface coating. Each coated panel 82 is about 1 inch thick.

The panels 82 are prefabricated as by sizing of a panel 97, priming and printing the upper surface 98 thereof and applying polyurethane, preferably in solution form, followed by curing of the panels to effect cross-linking of the polyurethane and to incidentally drive off solvent, if present. The surface 98 is preferably cylinder printed to provide a simulated pine design thereon to result in a uniform, yet natural, appearance.

Figure 8:
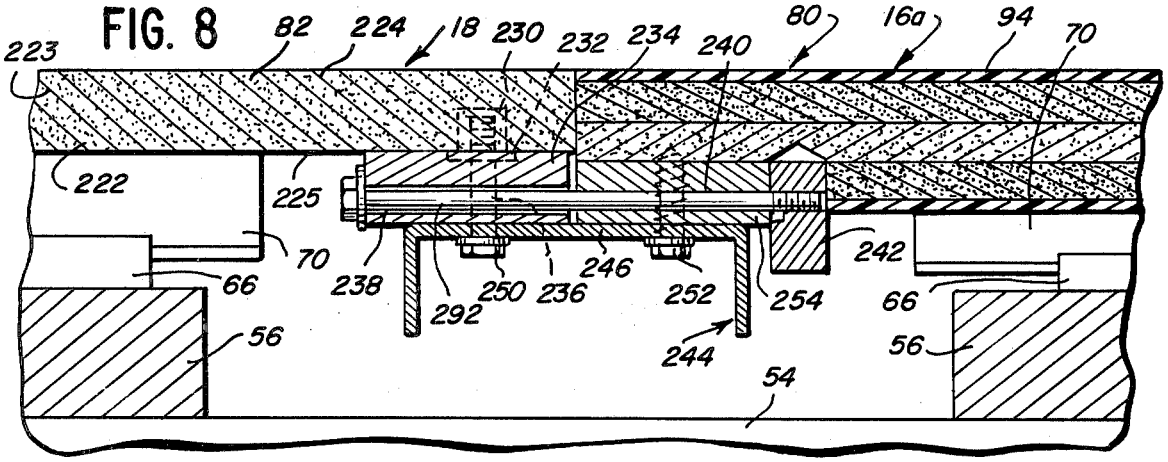
FIG. 8 is an enlarged sectional elevation of portions of head and pine lane sections and supporting structure of FIG. 1 taken approximately along the line 8—8 of FIG. 1.

Since the panels 82 are not laminated, they need not be symmetrical. Further, since the incidence of direct ball impact on the panels 82 is relatively low, the panels need not be as thick as the approach and head panels 80. For the sake of economy, the panels 82 are substantially less thick than the panels 80 with the difference in thickness being compensated for by the use of correspondingly thicker leveling wedges 66 and bevel strips 70, as best seen in FIGS. 2B and 8.

Panels 82 as described above have been found to exhibit exceptional dimensional stability and resistance to warping, due at least in part to their negligible tendency to absorb humidity. Flat upper surfaces of such panels 82 are exceptionally true and provide uniform, readily reproducible bowling characteristics from lane to lane. The absence of grain from the upper surface (as well as from the upper surface of laminate panels 80) contribute to uniformity and controllability of bowling characteristics. Further, the panels 82 are relatively economical to manufacture.

FIGS. 3 through 6 illustrate a method of securing the panels 80 to the underlying support structure, as well as a method of securing a gutter 34 to the supported lane structure 10. With reference to FIGS. 3 and 4, the lower laminate layer 96 of each panel 80 is supported on the horizontal upper surface 72 of one of a series of bevel strips 70. In order to securely retain the panel 80 thereagainst, a plurality of hold down clips 100 engage the lane panels 80 at longitudinally spaced points along the lane 10. Each clip 100 includes an upstanding wall section 102 alignable with a flat vertical side 104 of the panel 80. The wall 102 is secured to the panel 80 by any suitable means, such as by a machine screw 106 extending therethrough and into the panel 80.

Integral with and extending transversely from the clip wall section 102 is a base section 108 which terminates in a downwardly and outwardly extending foot 110 which abuts the leveler 56 to space the base 108 from the leveler 56. A machine screw 112 extends through the base 100 and into the leveler 56 to provide a downwardly directed force against the panel 80 to retain the bevel strip 70 and leveling wedges 66 in place after being properly positioned, as described below.

Referring to FIG. 4A, an alternate form **100*a* of the hold-down clip 100 is shown in place on a pine panel 80. The clip 100*a* terminates at the upper end of wall 102 in a downwardly angled tongue 114 extending into an inclined longitudinally extending groove 116 in the vertical side 104 of a panel 82. The tongue-in-groove structure of FIG. 4A facilitates ready installation of the clip 100*a* on the panel 82** and reduces the required number of screws.

During construction of a lane 10, after a panel 80 and 82 has been placed upon its associated bevel strip 70 and roughly aligned with adjacent panels 80 and 82, the leveling wedges 66 are transversely adjusted to selectively raise or lower the panels 80 and 82 to adjust the levels of the respective upper surfaces 94 and 98 to effect alignment thereof. When only negligible transverse and longitudinal variations in level remain, the hold-down clips 100 are secured to the panels 80 and **82*a* to the levelers 56**.

FIG. 4 illustrates the structure of a gutter 34 and its hold-down structure. A peripheral, longitudinally extending lip 118 projects outwardly from each respective head and pine section panel 80 and 82 to cover the hold-down clips 100 and the periphery of the gutter 34. The gutter 34 is preferably of vinyl-coated steel and includes a concave section 120 which terminates laterally at a convex shoulder 122 having a downwardly extending wall 124 terminating at its lower end in a U-shaped channel 126. Each of a plurality of gutter hold-down clips 128 has a U-shaped hook 130 at its upper end engaging the gutter channel 126 and a foot 132 at its lower end received under a leveler 56 to exert a downwardly directed force on the gutter wall 124 to maintain the gutter 34 in place between a respective head or pine panel 80 or 82, or the pin deck 20, and an adjacent filler strip or ball return tunnel (not shown), of conventional construction. The gutter 34 terminates laterally at the side opposite the shoulder 122 in an integral cap (not shown).

Figure 5:
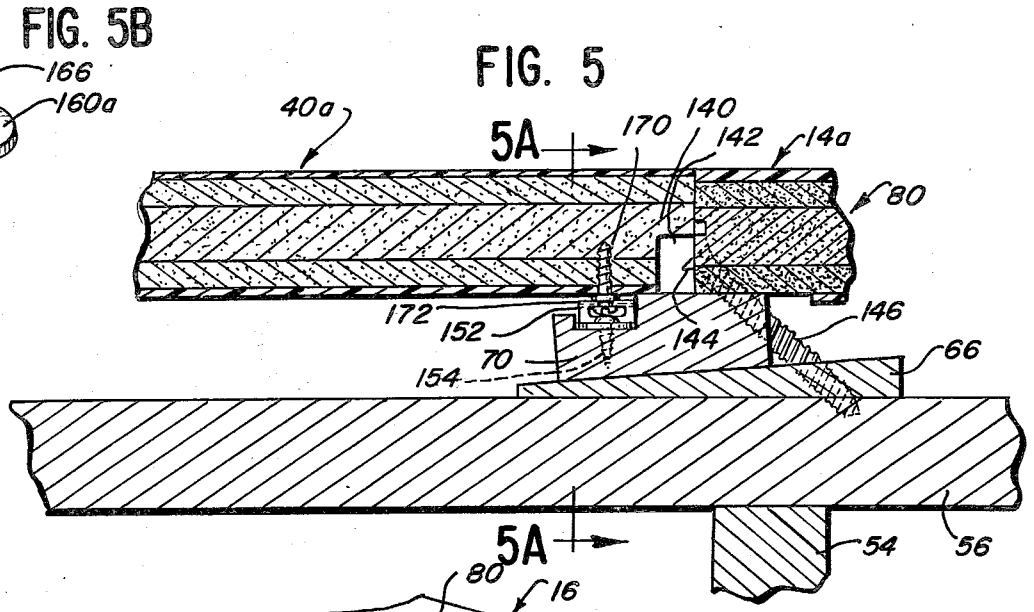
FIG. 5 is an enlarged sectional elevation of a portion of the lane and supporting structure of FIG. 5 taken approximately along the line 5—5 of FIG. 1.
Figure 5B:
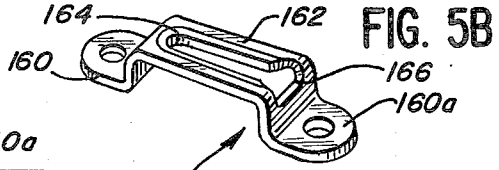
FIG. 5B is an enlarged perspective view of one element of the supporting structure shown in FIGS. 5 and 5A.
Figure 5A:
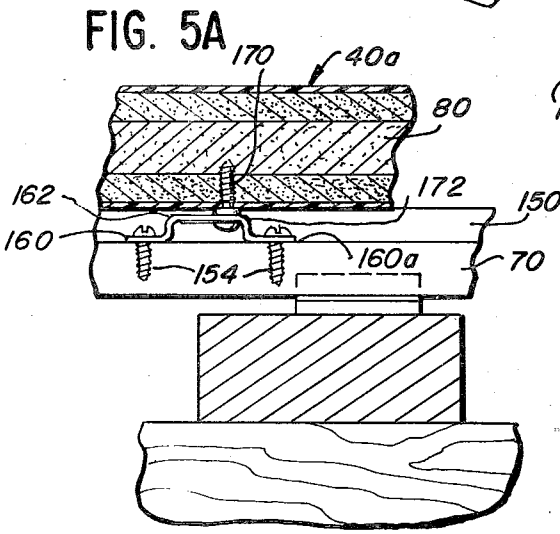
FIG. 5A is an enlarged sectional elevation of the lane and supporting structure of FIG. 5 taken approximately along the line 5A—5A of FIG. 5.

FIGS. 5–5B illustrate a typical filler panel **40*a* and its supporting structure. The panel 40*a* of FIG. 5 is disposed between an approach panel 14*a* and a filler panel (not shown) of an adjacent lane. The upstanding sides 104 of the panels 80 of the approach sections 14–14*a* are flush and mate with a transverse wall 136 of an outwardly extending lip 140 of the filler panel 40*a*. A cavity 142, defined by the lip 140 and the remainder of the panel 40*a*, receives a head 144 of a diagonally downwardly projecting screw 146 extending through an approach panel 80, bevel strip 70, leveling wedge 66 and into a stringer 56 to secure the panel 80 to the underlying support structure 56, 66 and 70**.

The bevel strip 70 has a longitudinally extending U-shaped channel 150 within which is secured a plurality of clips 152 (best seen in FIG. 5B) by screws 154. Each clip 152 has a pair of longitudinally extending rear and forward feet 160 and **160*a*, respectively, integral with a raised base 162 having a longitudinally extending tapered slot 164 with a mouth 166 at its widest end for receipt of a double-headed screw 170, as follows. Each of the clips 152 must be positioned with its mouth 166 toward the same end of the lane 10**.

Associated with each clip 152 is a double-headed screw 170 received in the lower side of the filler panel **40*a*. After the approach panels 14*a* have been secured to the supporting structure 56, 66 and 70 as in FIG. 5, the approach panels 40*a* are installed by aligning each screw 170 with an associated clip 152 with each screw 170 disposed outwardly of the mouth 166 of its associated clip 152. Longitudinal translation of the panels 40*a* to snugly wedge a shank 172 of each screw 170 in the slot 164 of an associated clip 152 will secure each panel 40** in place.

Figure 7:
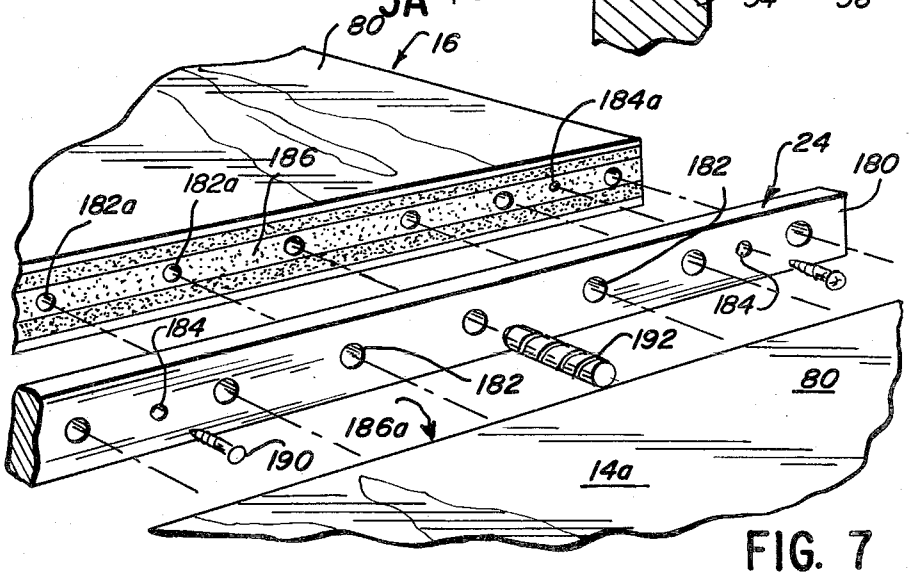
FIG. 7 is an exploded perspective view of the foul line and surrounding lane areas of FIG. 6.
Figure 6:
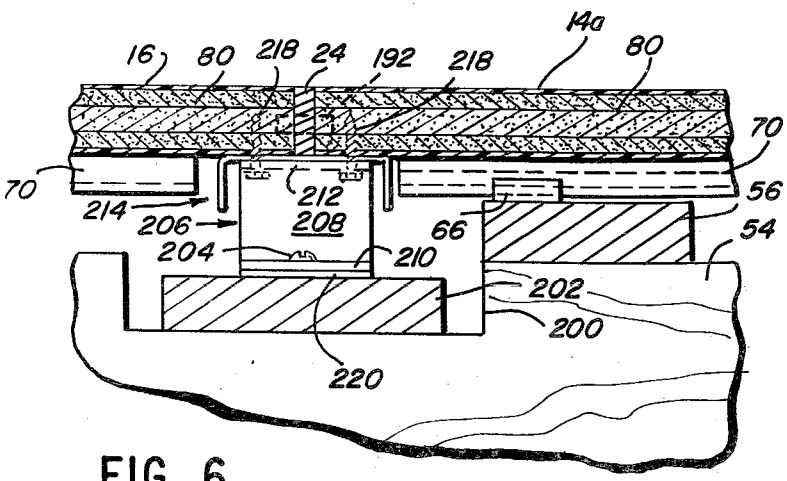
FIG. 6 is an enlarged sectional elevation of the foul line area of a lane of FIG. 1 taken approximately along the line 6—6 of FIG. 1.

FIGS. 6 and 7 illustrate the placement of the foul line 24 between the approach section **14*a* and the head section 16, as well as a method of joining two panels 80. Referring first to FIG. 7, the foul line 24 comprises a laminated strip 180** of several plies of a commercial grade of black vulcanized fiber (compressed gelatinized cotton material) having interply bond strength equal to or greater than the tensile strength of the plies in a direction parallel to the plane thereof.

A plurality of bores 182 and threaded screw bores 184 extending through the strip 180 are spaced along the length thereof. Associated with each bore 182 and 184 is a respective bore **182*a* and 184*a* in the transverse end surfaces 186 and 186***a* of the panels 80 corresponding to the lane sections 16 and 14*a*.

During construction, the strip 180 is lightly coated with adhesive and the foul line bores 182 and 184 are aligned with associated panel end bores 182*a* and 184*a* of one section 14*a* or 16 and screws 190 are received by the bores 184 and 184*a* to secure the strip 180 to a first panel 80. A plurality of channeled dowel rods 192 are then coated with adhesive and inserted into the bores 182 and 182*a* whereupon the bores 182*a* of the second panel 80 are aligned with and receive the dowel rods 192.

Referring to FIG. 6, aligned indented sections 200 of parallel stringers 54 support a transversely extending pad 202. Secured to the pad 202 as by screws 204 is a pair of spaced splice plate brackets 206 each of which comprise an upstanding plate 208 and vertically spaced lower and upper horizontal feet 210 and 212 integral therewith. Supported between the brackets 206 is a transversely extending channel 214 having a flat horizontal support plate 214 which supports the panels 80 of the respective lane sections 14*a* and 16 and the foul line 24. The channel 214 is disposed between the terminal point of the bevel strips 70 supporting each lane panel 80.

A plurality of hex head screws 218 extend upwardly through the splice plate foot section 212 and the plate 215 into the respective lane panels 80. The splice plate bracket 206 and the channel 214 are secured to the panels 80 only after the surface levels thereof have been adjusted. If required, a shim 220 may be disposed under the bracket foot section 210.

Figure 9:
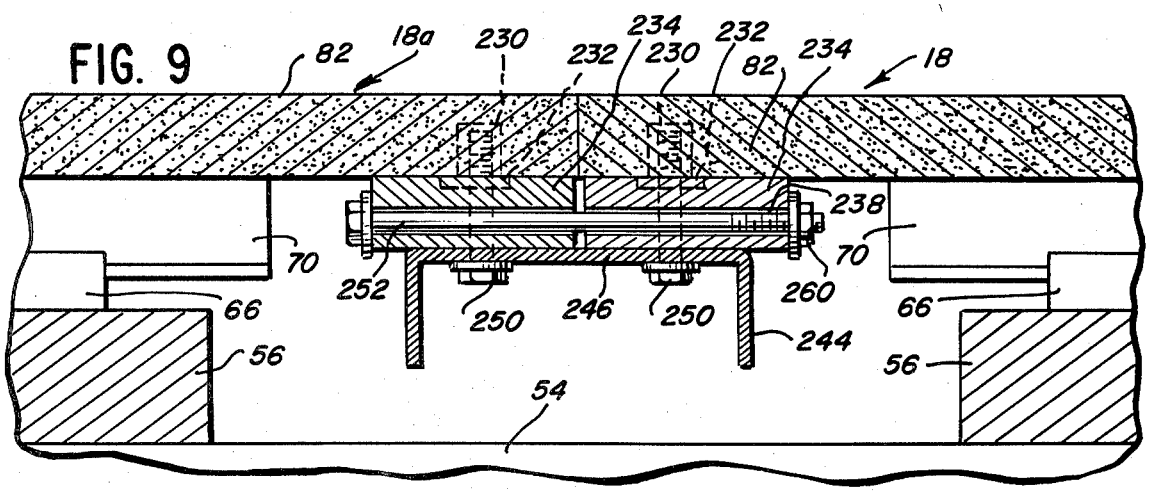
FIG. 9 is an enlarged sectional elevation of two pine lane sections and supporting structure of FIG. 1 taken approximately along the line 9—9 of FIG. 1.
Figure 10:
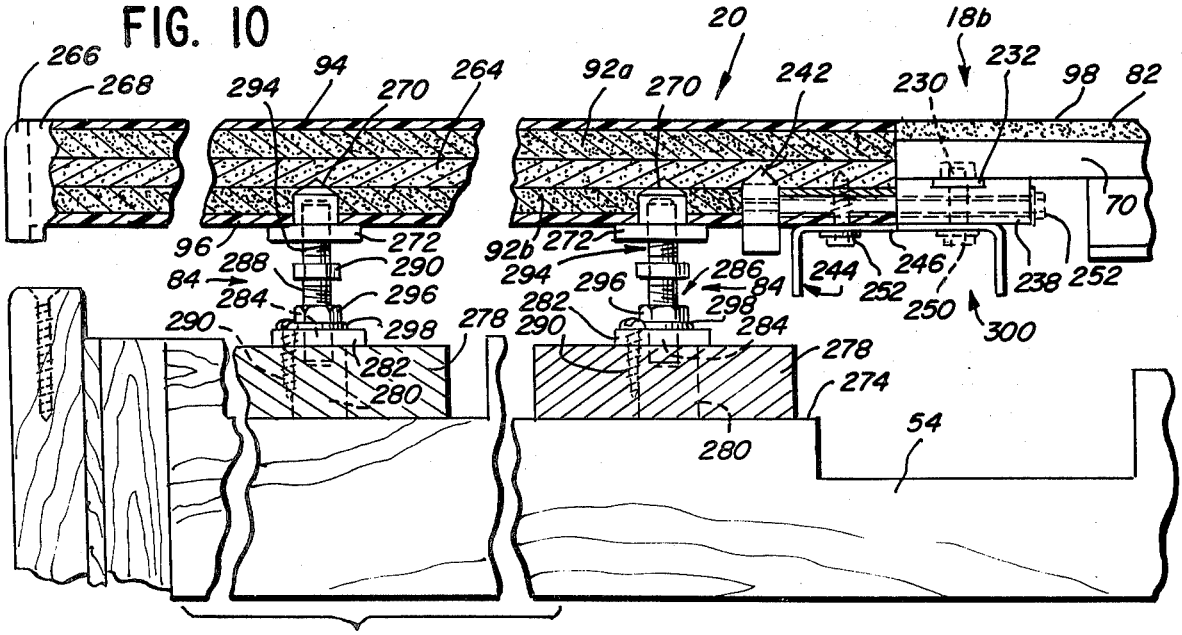
FIG. 10 is an enlarged fragmentary sectional elevation of the pin deck and a portion of a pine lane section of FIG. 1 taken approximately along the line 10—10 of FIG. 1.

Referring to FIGS. 8–10, methods of joining panels 80 and 82 to each other are illustrated. In FIG. 8, the interface between the panel 80 of head section 16*a* and the panel 82 of approach section 18 is shown.

Each panel 82 in FIGS. 8 thru 10 has a plurality of transversely spaced clearance holes 230 in opposite ends on the underside 231 thereof with a threaded nut 232 disposed coaxially thereover. A spacer pad 234 is secured to and extends transversely across the underside 231 with threaded bores 235 coaxial with each nut 232 and clearance hole 230. Each pad 234 also has a plurality of longitudinally extending bolt receiving bores 238 extending therethrough.

The end of the panel 80 has a plurality of longitudinal bores 240 alignable with the bores 238 of the pad 234 terminating in a threaded cap 242 received in the underside 243 of the panel 80.

A channel 244 having a flat base 246 extends transversely of the panels 80 and 18 with the base 246 in abutment with the spacer pad 234 and the panel underside 243. The plate 246 has elongae slots 248 for receipt of bolts 250 which extend therethrough and are threadedly received by the nuts 232, and for receipt of cutting screws 252 which extend therethrough and into the panel 80. A shim 254 may be inserted between the panel 80 and the plate 245 as required to adjust the upper surface level of the panel 80.

It will be apparent to those skilled in the art that the respective upper surface levels of the panels 82 and 80 may be adjusted by adjustment of the screws 250 and 252 with insertion of a shim 254, when appropriate, between the plate 245 and the underside of the panel 80.

In order to ensure tight abutment of the panels 80 and 82, a draw bolt 256 of substantially smaller diameter than the bore 238 is received by each aligned pair of bores 238 and 240 and is threadedly received by each cap 242. A joining structure identical to that of FIG. 8 joins the pin deck 20 and panel 82 of FIG. 10, described below.

FIG. 9 illustrates the interface of two panels 82 of lane sections 18 and 18*a* or, alternately, 18*a* and 18*b*. Adjustment of the bolts 250 within the nuts 232 effects relative adjustment of the upper surface levels of the lane sections 18 and 18*a*. Since the longitudinal bores 238 of each pad 234 are of a greater diameter than the bolts 252, limited vertical adjustment of the panels 82 may be effected without interference from the bolt 252. Tightening of the bolt 252 within a nut 260 threadedly receiving the bolt 252 ensures tight abutment of the panels 82 with each other.

Referring now to FIG. 10, the pin deck 20 and associated supporting structure will be described in detail. The pin deck 20 comprises an extremely highly impact- and abrasion-resistant laminate constructed very similarly to the head, approach and filler panels 80 but having a core layer 264 of high-density resin-bonded particle board or fiber board, such as comprising the layers 92*a* and 92*b* of the panels 80. The core layer 264 is laminated between two high-density particle board layers 92*a* and 92*b*. The upper and lower pin deck surfaces 94 and 96, respectively, comprise plastic laminate panels identical to those of the head and approach upper and lower surfaces 94 and 96, but without a decoratively printed layer. The upper panel 94 has an opaque layer with pin spots 30 thereon.

It will be apparent to those skilled in the art that the pin deck 20 must be at least as abrasion- and impact-resistant as the lane panels 80 due to the extremely heavy impact forces applied to the pin deck 20 by bowling balls and pins during use. The use of a high-density particle board core layer 264 enhances the impact resistance of the pin deck 20.

The layers 92–96 and 264 are secured together by a suitable adhesive disposed between the respective layers. The symmetrical construction of the pin deck 20 prevents warping which would otherwise occur due to unequal expansion or contraction of the layers 100–106 caused by temperature and humidity effects.

After the layers 92–96 and 264 are secured together, the pin deck 20 is sized, and a suitable end cleat 266 and side cleats 268 are secured thereto. Two longitudinally spaced pairs of transversely spaced bores 270 are drilled in the lower surface 96 and a threaded nut 272 is secured thereover coaxially therewith.

After the panels 80 have been installed, the pin deck 20 may be installed. Extending between and secured to indented sections 274 of the stringers 54 are transversely extending 2×6 pads 278. Each pad 278 has a pair of laterally spaced clearance holes 280 alignable with the pin deck bores 270. A foot plate 282 having a threaded bore 284 is secured to each pad 278, as by screws 290, with each bore 284 being coaxial with an associated clearance hole 280. The bores 284 are reverse threaded with respect to the nuts 272.

Threadedly received within each bore 284 is a threaded lower end 286 of an adjustable screw 288 having a central hex head 290 and a threaded upper end 294. A jam nut 296 is threadedly received on each screw end 286 and a lock washer 298 is disposed on each screw end 286 adjacent the associated foot 292. The upper end 294 of each screw 288 is threadedly received by the nut 272.

With the jam nut 296 positioned adjacent the hex head 290, the ends 286 and 294 of each adjusting screw 288 may be inserted into their associated nut and foot 272 and 282 by rotation of the screw 288. After assembly of each adjusting screw 288 to its associated nut and foot 272 and 282, the level of the pin deck 20 may be adjusted by adjustment of the screws 288 to eliminate longitudinal and transverse level variations of the pin deck surface 94 and to position the pin deck surface 94 in substantial horizontal alignment with the lane surface 98.

After the pin deck surface level has been adjusted, each jam nut 296 may be positioned by rotation to tightly abut its associated lock washer 298, thereby preventing further rotation of the adjusting screws 288 in order to prevent undesirable dislocation of the pin deck 20 during use.

A supporting structure 300 identical to the structure of FIG. 8, with like elements being identified by like reference numerals, is disposed at the interface of the pin deck 20 and the panel 82 of the lane section 18*b* to ensure abutment of the pin deck 20 to the lane section 18*b*.

American Bowling Congress regulations require that there be absolutely no rise in level from the initial approach sections 14 to the pin deck 20, but a drop of no more than 0.015 between adjacent lane sections is allowable. It will be apparent to those skilled in the art that the surface level of each section 14–20 of a lane made according to the present invention may be independently adjusted to eliminate longitudinal and transverse level variations, as described herein.

The prefabricated lane sections 14–20 and filler sections 40 may be brought to the lane construction site after preliminary assembly of the crib foundation. It will be appreciated that assembly of individual lane and filler section with gutters, ball return mechanisms and other peripheral equipment may be accomplished in a shorter time period than required for assembly of conventional wood lanes.

The lane and method of construction of the same, as described herein, exhibit several distinct advantages over prior bowling lane structures and methods of construction.

It has been found that the synthetic lane surface of the present invention exhibit enhanced resistance to impact, abrasion, fire and stain. The high-density structure of approach and head panels and the pin deck results in enhanced resistance to visual surface damage from lofted and dropped bowling balls.

For example, a head section made as described above was found to resist visual surface damage from 20,000 impacts of a 16 lb. bowling ball lofted 16 inches above the surface, and similarly showed no visual surface damage from a 16 lb. ball dropped thereon from heights of up to 10 feet. In a test of wear resistance conducted according to the Standard National Electrical Manufacturer Association Test LD-3.301, the surface laminate 94 of a head section withstood 4,400 cycles on a Taber Abraser before wearing through. Prolonged application of a burning cigarette to the surface produced only minor discoloration which was easily wiped clean with no charring. Application of alcohol, detergent, shoe polish and mustard for periods up to 24 hours produced no stain. Astrolane 100 brand polyurethane, used to coat the pine sections 18–18*b*, is formulated to produce a surface which, with conventional maintenance, has a coefficient of friction and other characteristics similar to wooden bowling lane surfaces. It has further been found that conventionally maintained synthetic approach and head sections 14–16 of the invention have surface characteristics similar to those of conventional wooden lane surfaces and, as a result, lanes made according to the invention exhibit bowling characteristics comparable to those of wooden lanes. It may be appreciated that the standardized production of the decorative surfaces of the lane results in a uniform, yet natural, appearance.

Further, damaged or worn sections of bowling lanes made according to the invention may be removed and replaced, unlike prior wooden lanes which, due to the random strip structure thereof, are not subject to sectional replacement. Also, it has been found that bowling proprietors using the lane resurfacing method of the invention may experience a reduction in casualty insurance premiums of up to 10% due to the elimination of hazardous lacquers heretofore utilized in the resurfacing process, which is not required with the lanes of the present invention.

We claim:

1. A bowling lane, comprising:

(a) support means; and (b) a plurality of individual longitudinally extending panels supported on said support means in end-to-end relation, each said panel having an upper, substantially flat, horizontal bowling surface at substantially the level of the bowling surfaces of the remaining panels, at least one of said panels being a symmetrical multi-layer laminate comprising (1) a core layer having upper and lower surfaces, and (2) a pair of panels of a highly impact-resistent and abrasion-resistant plastic laminate, each said panel being secured to a respective one of said upper and lower core layer surfaces, one said plastic laminate panel defining said bowling surface, said core layer comprising a shock absorbing phenol-formaldehyde resin-bonded particle board material having a density of between about 62 and 87 lb/ft$^3$ and of a thickness such that said core layer has hardness, tensile strength and stiffness characteristics sufficient to substantially uniformly distribute stress imparted by a bowling ball lofted onto said bowling surface from said one plastic laminate panel to said support means over an area sufficiently large to prevent permanent deformation of said one plastic laminate panel.

2. The bowling lane of claim 1 wherein said core layer is of a material having a hardness of between about 2500 lb. (Janka) and M100 (Rockwell), a tensile strength of greater than about 320 psi, and an elastic modulus of between about 400,000 psi and 1,300,000 psi.

3. The bowling lane of claim 2 wherein said particle board has a density of between about 62–65 lb/ft$^3$, a tensile strength of greater than about 350 psi, a hardness of about 3,000 lb. (Janka) and an elastic modulus of about 680,000 psi.

4. The bowling lane of claim 3 wherein said core layer has a thickness of about 1½ inch and each said plastic laminate panel has a thickness of about ⅛ inch.

5. The bowling lane of claim 1 wherein said core layer is a laminate comprising a pair of panels of said shock-absorbing material and a support panel having upper and lower surfaces, said shock absorbing panels being secured to said upper and lower support panel surfaces symmetrically about said support panel to define said upper and lower core layer surfaces.

6. The bowling lane of claim 5 wherein said support panel has a thickness of about ¾ inch and each said shock absorbing panel has a thickness of about ⅜ inch.

7. A bowling lane, comprising:

(a) support means; and (b) a plurality of longitudinally extending approach, head and pine sections comprising individual panels supported on said support means and releasably secured together in end-to-end relation, each said panel having an upper, substantially flat, horizontal bowling surface at substantially the level of the bowling surfaces of the remaining panels, at least one of said approach and head panels being a symmetrical multi-layer laminate comprising (1) a core layer having upper and lower surfaces, and (2) a pair of panels of a highly impact-resistant and abrasion-resistant plastic laminate, each said plastic panel being secured to a respective one of said upper and lower core layer surfaces, one said plastic laminate panel defining said bowling surface, said core layer being a laminate of a pair of shock-absorbing panels and a support panel having upper and lower surfaces, said shock-absobing panels being secured to said upper and lower support panel surfaces symmetrically about said support panel to define said upper and lower core layer surfaces, said shock-absorbing panels being of a phenol-formaldehyde resin-bonded particle board material having a density of between about 62 and 87 lb/ft$^3$ and of a thickness such that each said shock-absorbing panel has hardness, tensile strength and stiffness characteristics sufficient to substantially uniformly distribute stress imparted by a bowling ball lofted onto said bowling surface from said one plastic laminate panel to said support means over an area sufficiently large to prevent permanent deformation of said one plastic laminate panel.

8. The bowling lane of claim 7 wherein said pine section panels comprise resin-bonded particle board or fiberboard, the bowling surface of said panels having a coating of impact-resistant and abrasion-resistant polyurethane.

9. The bowling lane of claim 8 wherein each said pine section panel has a thickness of at least about one inch.

10. The bowling lane of claim 7 wherein the material of said shock-absorbing panels has a hardness of between about 2500 lb. (Janka) and M100 (Rockwell), a tensile strength of greater than about 320 psi, and an elastic modulus of between about 400,000 psi and 1,300,000 psi.

11. The bowling lane of claim 10 wherein said particle board has a density of between about 62–65 lb/ft$^3$, a tensile strength of greater than about 320 psi, a hardness of about 3,000 lb. (Janka) and an elastic modulus of about 680,000 psi.

12. The bowling lane of claim 11 wherein said support layer has a thickness of about ¾ inch, each said shock-absorbing panel has a thickness of about ⅜ inch, and each said plastic laminate panel has a thickness of about ⅛ inch.

13. In a bowling lane having a pair of gutters adjacent thereto and lane leveling and lane support structure positioned below said lane, the improvement wherein said lane comprises a plurality of prefabricated lane modules which form a complete bowling lane when installed end-to-end, each lane modulus comprising:

(a) a base;

(b) a panel defining a bowling surface, said panel being integral with the upper surface of said base and having a width greater than the width of said base to form a female notch along each side of said lane module for securing one side of each adjacent gutter to said lane module, said panel comprising a sheet of synthetic plastic laminate which defines said bowling surface and a substrate of phenol-formaldehyde resin-bonded particle board supporting said plastic laminate; and (c) securing means for attaching said lane module to said lane support structure.

14. The bowling lane of claim 13 wherein the improvement further includes coupling means for rigidly coupling an end surface of said lane module to an adjacent end of an adjacent lane module.

15. The bowling lane of claim 13 wherein said securing means includes a plurality of straps coupled to the base of said lane module and extending downwardly therefrom into engagement with said lane support structure.

16. The bowling lane of claim 15 wherein each of said straps has an end inserted into one pair of slots in the base of said lane module to securely attach each of said straps to said lane module.

17. In a bowling lane having lane support means positioned below said lane, the improvement wherein said lane comprises a plurality of prefabricated lane modules installed end-to-end on said support means, each said lane module defining a flat, horizontal bowling surface, at least one said module comprising a symmetrical multi-layer laminate comprising (1) a core layer having flat upper and lower surfaces, and (2) a pair of panels of a highly impact-resistant and abrasion-resistant plastic laminate, each said panel being secured to a respective one of said upper and lower core layer surfaces, one said plastic laminate panel defining said bowling surface, said core layer comprising a shock-absorbing phenol-formaldehyde resin-bonded particle board material having a density of between about 62 and 87 lb/ft$^3$ and of a thickness such that said core layer has hardness, tensile strength and stiffness characteristics sufficient to substantially uniformly distribute stress imparted by a bowling ball lofted onto said bowling surface from said one plastic laminate panel to said support means over an area sufficiently large to prevent permanent deformation of said one plastic laminate panel.

18. A bowling lane, comprising:

(a( support means; and (b) a plurality of individual longitudinally extending panels supported on said support means in end-to-end relation, each said panel having an upper, substantially flat, horizontal bowling surface at substantially the level of the bowling surface at substantially the level of the bowling surfaces of the remaining panels, at least one of said panels being a symmetrical multi-layer laminate comprising (1) a core layer having upper and lower surfaces, and (2) a pair of panels of a highly impact-resistant and abrasion-resistant plastic laminate, each said panel being secured to a respective one of said upper and lower core layer surfaces, one said plastic laminate panel defining said bowling surface, said core layer comprising a shock-absorbing phenol-formaldehyde resin-bonded particle board material having a density of between about 62 and 65 lb/ft$^3$ and of a thickness and having hardness characteristics sufficient to substantially uniformly distribute stress imparted by a bowling ball lofted onto said bowling surface from said one plastic laminate panel to said support means over an area sufficiently large to prevent permanent deformation of said one plastic laminate panel.

19. The bowling lane of claim 18 wherein said core layer has a thickness of about $1\frac{1}{2}$ inch and each said plastic laminate panel has a thickness of about $\frac{1}{8}$ inch.

20. The bowling lane of claim 18 wherein said core layer is a laminate comprising a pair of panels of said shock-absorbing material and a support panel having upper and lower surfaces, said shock-absorbing panels being secured to said upper and lower support panel surfaces symmetrically about said support panel to define said upper and lower core layer surfaces.

21. The bowling lane of claim 20 wherein said support panel has a thickness of about $\frac{3}{4}$ inch and each said shock-absorbing panel has a thickness of about $\frac{3}{8}$ inch.

22. A bowling lane, comprising:

(a) support means; and (b) a plurality of longitudinally extending approach, head and pine sections comprising individual panels supported on said support means and releasably secured together, each said panel having an upper, substantially flat and horizontal bowling surface at substantially the level of the bowling surfaces of the remaining panels, at least one of said approach and head panels being a symmetrical multi-layer laminate comprising (1) a core layer having upper and lower surfaces, and (2) a pair of panels of a highly impact-resistant and abrasion-resistant plastic laminate, each said plastic laminate panel secured to a respective one of said upper and lower core layer surfaces, one of said plastic laminate panels defining said bowling surface, said core layer being a laminate of a pair of shock-absorbing panels and a support panel having upper and lower surfaces, said shock-absorbing panels being secured to said upper and lower support surfaces, said shock-absorbing panels being secured to said upper and lower support panel surfaces symmetrically about said support panel to define said upper and lower core layer surfaces, said shock-absorbing panels being of a phenol-formaldehyde resin-bonded particle board material having a density of between about 62 and 65 lb/ft$^3$ and of a thickness and having hardness characteristics sufficient to substantially uniformly distribute stress imparted by a bowling ball lofted onto said bowling surface from said one plastic laminate panel to said support means over an area sufficiently large to prevent permanent deformation of said one plastic laminate panel.

23. The bowling lane of claim 22 wherein said pine section panels comprise resin-bonded particle board or fiberboard, the bowling surface of said panels having a coating of impact-resistant and abrasion-resistant polyurethane.

24. The bowling lane of claim 23 wherein each said pine section panel has a thickness of at least about one inch.

25. The bowling lane of claim 24 wherein said support layer has a thickness of about $\frac{3}{4}$ inch, each said shock-absorbing panel has a thickness of about $\frac{3}{8}$ inch, and each said plastic laminate panel has a thickness of about $\frac{1}{8}$ inch.

26. In a bowling lane having lane support means positioned below said lane, the improvement wherein said lane comprises a plurality of prefabricated lane modules installed end-to-end on said support means, each said lane module defining a flat, horizontal bowling surface, at least one said module comprising a symmetrical multi-layer laminate comprising (1) a core layer having flat upper and lower surfaces, and (2) a pair of panels of a highly impact-resistent and abrasion-resistant plastic laminate, each said panel being secured to a respective one of said upper and lower core layer surfaces, one said plastic laminate panel defining said bowling surface, said core layer comprising a shock-absorbing phenol-formaldehyde resin-bonded particle board material having a density of between about 62 and 65 lb/ft$^3$ and of a thickness and having hardness characteristics sufficient to substantially uniformly distribute stress imparted by a bowling ball lofted onto said bowling surface from said one plastic laminate panel to said support means over an area sufficiently large to prevent permanent deformation of said one plastic laminate panel.

27. A method of prefabricating a lane module for incorporation in a bowling lane wherein a plurality of said prefabricated lane modules form a complete bowling lane when installed end-to-end, each said lane having a pair of gutters adjacent thereto and leveling means and lane support structure positioned therebelow, said method comprising the steps of:

(a) providing a base;

(b) forming a panel defining a bowling surface and having a width greater than the width of said base, said panel comprising a sheet of synthetic plastic laminate which defines said bowling surface and a substrate of phenol-formaldehyde resin-bonded particle board supporting said plastic laminate;

(c) joining said panel to the upper surface of said base in overlapping relationship to form a female notch along each side of said lane module for receipt of one side of an adjacent gutter when said module is in place in said lane; and (d) providing means for securing said lane modulus to said lane support structure.

28. The method of claim 27 further including the step of providing means for coupling an end surface of said lane module to an adjacent end of an adjacent lane module.

* * * * *